United States Patent [19]

Holdt et al.

[11] 4,346,487

[45] Aug. 31, 1982

[54] QUICK RELEASE MANUAL TYPE FOWLER FOR HOSPITAL STRETCHERS

[75] Inventors: Donald H. Holdt; Donald B. Morgan, both of Cambridge, Md.

[73] Assignee: Whittaker Medical Manufacturing Company, Richmond, Va.

[21] Appl. No.: 143,557

[22] Filed: Apr. 25, 1980

[51] Int. Cl.[3] ..... A47C 20/04; A61G 7/00; A61G 1/02

[52] U.S. Cl. ..... 5/74 R; 5/433

[58] Field of Search ..... 5/433, 72, 74 R, 74 B, 5/75, 76, 77, 79

[56] References Cited

U.S. PATENT DOCUMENTS 3,800,338 4/1974 Smith ..... 5/433

4,222,131 9/1980 Holdt et al. ..... 5/79

FOREIGN PATENT DOCUMENTS 859301 10/1952 Fed. Rep. of Germany ..... 5/74

*Primary Examiner*—Alexander Grosz

*Attorney, Agent, or Firm*—Donald E. Nist

[57] ABSTRACT

A quick release Fowler for hospital stretchers of the manual as opposed to the crank actuated type. A ratchet bar attached to the frame is provided with a sliding block and a pin that fits into slots in the ratchet bar. The pin is operated with respect to the slots remotely by a cable attached to a trigger/handle assembly at the head end of the Fowler. Safety means are provided so that the Fowler cannot be inadvertently lowered without the attendant assuming the weight of the Fowler, with or without a patient thereon, himself. The ratchet bar also permits a 90° raised position of the Fowler to the stretcher top.

17 Claims, 7 Drawing Figures

10°
20°
30°
40°
50°
60°
70°
90°
10
12
14
16
18
20
21
22
24
26
28
30
32
34
36
38
50
59
60
62
64
66
68
2

QUICK RELEASE MANUAL TYPE FOWLER FOR HOSPITAL STRETCHERS

This invention relates to hospital stretchers, and more in particular it pertains to an improved mechanism for controlling the head or back rest of such stretchers.

Hospital stretchers have a back rest to permit the patient to sit up while holding the patient's head and upper torso in an adjusted inclined position with respect to the remainder of the stretcher top. This is known as the "Fowler" position, and the mechanism has come to be called the "Fowler" mechanism. Accordingly, the word "Fowler", as used throughout the specification and claims hereof, shall be understood to mean such a portion of such a stretcher.

Fowlers can be of two types; the more expensive more complicated crank type of actuators; and the simplier, lighter, less expensive manual types which includes the present invention. As is obvious, one trades off the higher cost and greater weight of the crank type for the greater simplicity but need to operated manually of the manual type, the decision being dependent upon the use to which the particular stretcher will be put.

Examples of crank type Fowlers can be found in Tabbert U.S. Pat. No. 3,050,745, and a copending patent application Ser. No. 942,528, filed on Sept. 15, 1978 by Donald Harvey Holdt and James Stanley Sims Jr., inventors, entitled "Hook Type Fowler for Hospital Stretchers," and now U.S. Pat. No. 4,222,131, both assigned to the same assignee as the present invention. An example of a manual type Fowler is found in Smith U.S. Pat. No. 3,800,338. Smith teaches a simple bail 16, the cross run of which cooperates with dual ratchet means which permit greater ease in moving the bail cross run from one notch to another. However, Smith does not have a return portion in the ratchet teeth, nor does he have the other safety means and head end remote operation ability of the present invention.

A problem with prior art crank type Fowlers generally not present in the invention or most manual types is that a quick lowering of the patient to a fully reclined position is difficult to achieve because the crank has to be turned many times. These cranks typically have a relatively fine pitch thread to permit gentle motion of the patient, infinite adjustment and to prevent "sliding" or thread slippage.

Thus, primary objects of the invention are to provide a quick release for manual or non-crank operated type Fowlers to permit quick lowering, to do so safely, and to permit quick return to any selected adjusted position, while retaining all of the advantages of prior art manual types.

Another object of the invention is to provide means to prevent inadvertant disengagement of the quick release mechanism. If the quick release mechanism were inadvertantly disengaged with a patient on the stretcher, the patient's head and upper torso would be rapidly slammed down onto the top of the stretcher, thus possibly injuring the patient and certainly startling him or her.

As still another object, the invention provides a handle and trigger for the quick release mechanism located in the ideal place for the attendant's hand; at the upper or head end of the Fowler. The attendant can simultaneously raise the Fowler to disengage the interlock or safety part of the invention, operate the quick release, thereupon himself assuming the weight of the patient, to only then gently and safely lower the patient.

More specifically, the invention provides a ratchet rod that extends longitudinally of the stretcher top. A linkage extends from the ratchet rod to the Fowler to control its motion and to support it at anyone of a plurality of predetermined adjusted positions. A manually operated trigger is provided at the upper outer end of the Fowler. This trigger is so configured and so located with respect to a closely adjacent handle at the Fowler head end that the operator will naturally assume the weight of the Fowler and the patient's upper torso by grasping the handle with his hand and four fingers, his thumb being at that time conveniently positioned to operate the trigger. An aviation type push-pull cable is located between the trigger and a traveling assembly mounted on the ratchet bar. This cable is effectively used only in one direction, because of the safety spring. This spring is positioned between the trigger and the head end and in line with the cable so that the trigger cannot be operated when weight is on the ratchet bar. When weight is on the ratchet bar via the linkage, this spring will simply stretch to absorb the trigger motion. The ratchet bar slots are provided with slight return portions which cooperate with the traveling block pin to assure this goal.

Thus, the attendant must first lift the Fowler slightly using the handle to bring the pin out from under the ratchet bar slot return portion, and can only then operate the trigger to disengage the traveling block from the ratchet bar, to thereby permit lowering motion. Any attempt to release the trigger without so lifting the weight will simply stretch the spring located in line with the push-pull cable. This is the invention safety against inadvertant quick lowering.

This same arrangement, however, has the additional advantage of permitting unfettered raising motion, with or without the patient's weight being relieved from the Fowler.

Another advantage is that this arrangement permits operation of the Fowler, for raising or lowering, with only one hand of the attendant, subject of course to the weight of the patient and the strength of the attendant.

Another advantage is that the spacing of the slots in the ratchet bar is such that the Fowler will move in equal angular 10° intervals. Further, the extreme position, the last slot in the ratchet bar, is such that the Fowler can achieve a full 90° relationship to the remainder of the top; which is a new feature not heretofore available in the prior stretchers mode and sold by the assignee of this invention.

The above and other advantages of the invention will be pointed out or will become evident in the following detailed description and claims, and in the accompanying drawings also forming a part of the disclosure, in which:

Figures 1, 3:
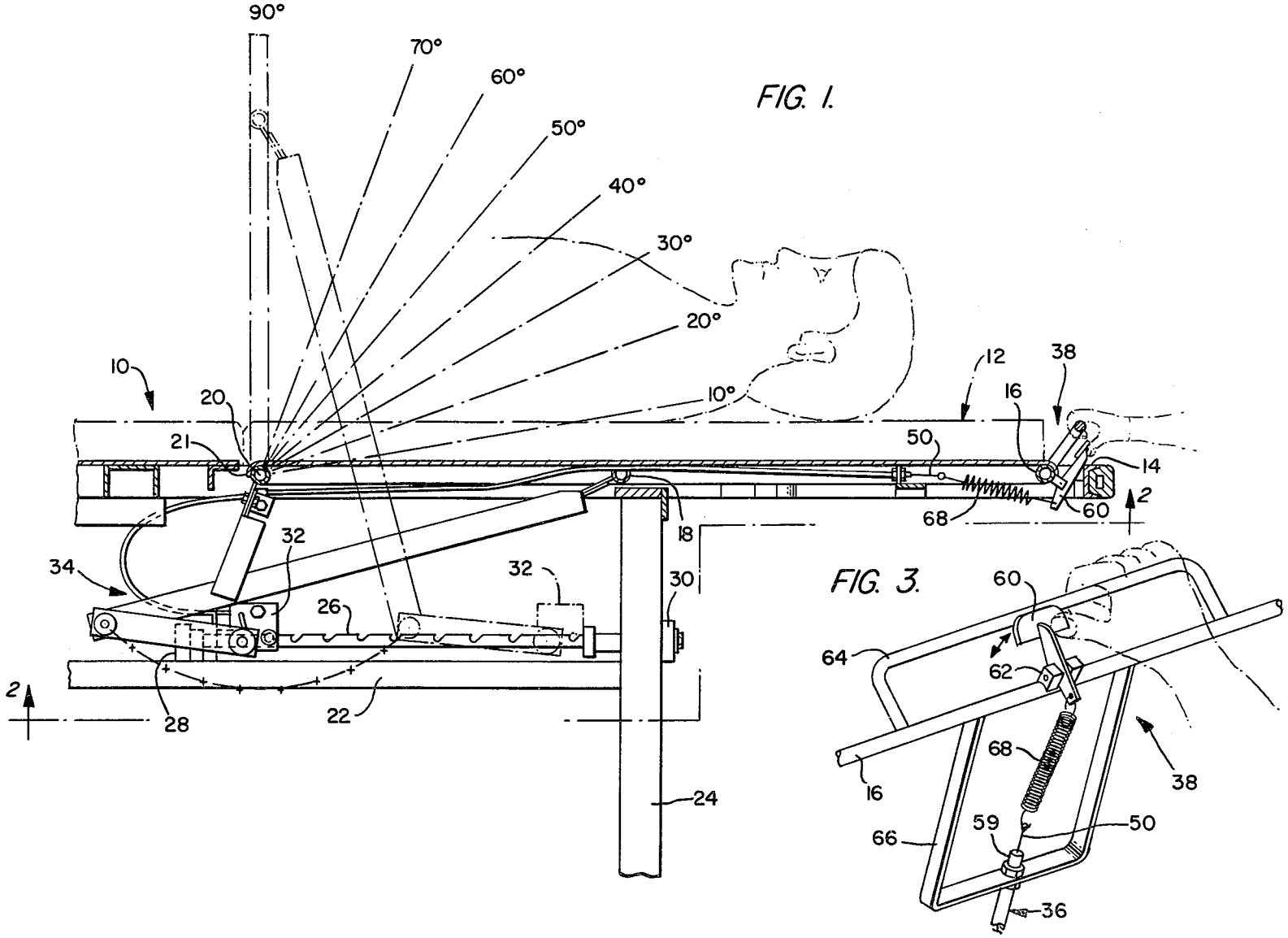
FIG. 1 is a side elevational view, partly schematic, showing the invention in use on a hospital stretcher and illustrating the various adjusted positions.
FIG. 3 is a fragmentary perspective view showing the manner of operation of the handle and trigger.
Figure 2:
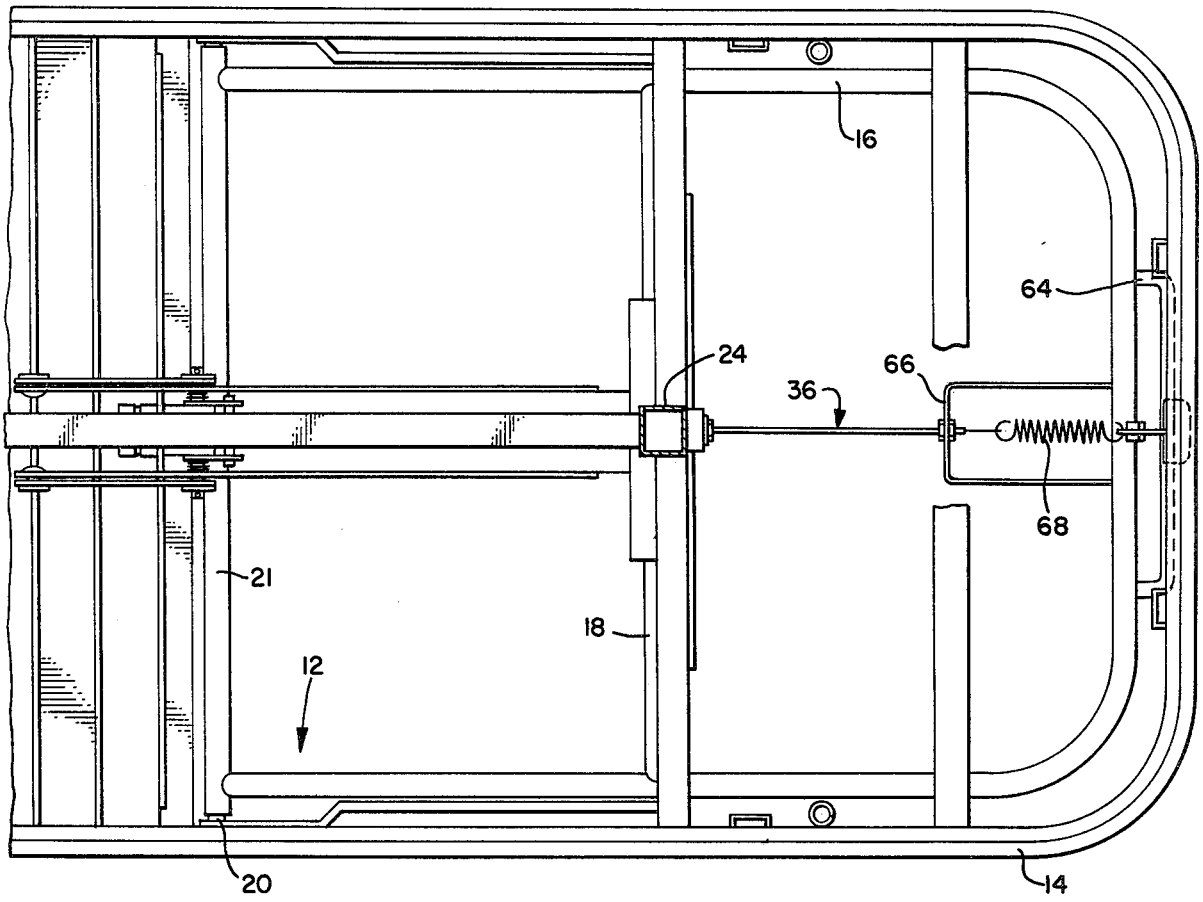
FIG. 2 is a top plan view in the fully reclined position.

Referring now in detail to the drawings, there is shown a hospital stretcher 10 with a Fowler 12 mounted on a stretcher top frame 14. Further details as to the stretcher per se can be found in the above-identified patents and are in any case well known to those skilled in the art.

To the extent pertinent Fowler 12 comprises a "U" shaped frame member 16 cross-connected by a frame member 18 and pivoted at 20 to the top frame 14. The top frame 14 comprises a frame member 22 which is mounted on a post member 24 which may be moved vertically up and down by other mean to adjust the height of the stretcher top.

The Fowler 12 is completed by a cross member 21 made of the same kind of tubular material as is "U" member 16 and the cross piece 18, and the pivot is conveniently provided by pins which are secured to the frame top 14 and extends into the end tubular member 21.

The ratchet bar 26 of the invention is secured to the frame by having one end fixed to the main frame member as at 28, and the opposite end fixed to the post 24 as at 30.

A traveling block assembly 32 is mounted for longitudinal sliding movement on the ratchet bar 26, and carries linkage 34 which extends from the traveling block 32 to the cross piece 18 of the Fowler. As indicated by the schematic phantom showing in FIG. 1, the various positions of the traveling block with respect to the ratchet bar 26 controls the angle of inclination of the Fowler with respect to stretcher top.

Figure 4:
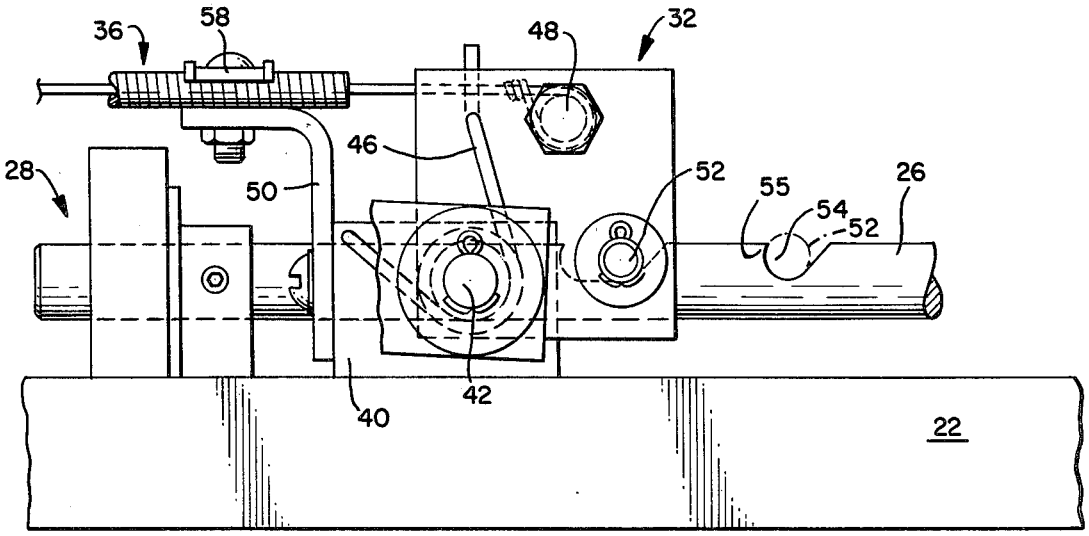
FIG. 4 is a side elevational view of the traveling block shown in the fully reclined position.
Figure 5:
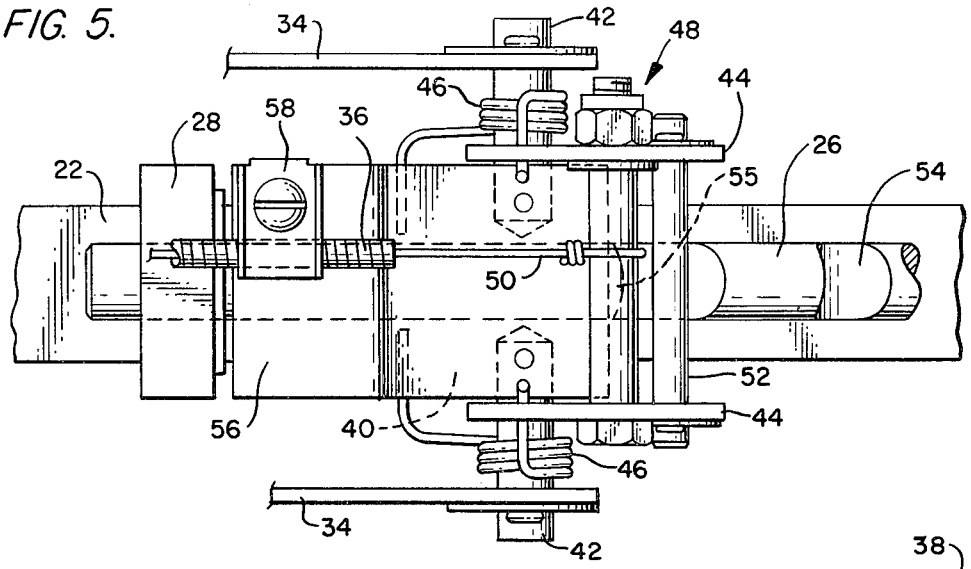
FIG. 5 is a top elevational view of the traveling block.
Figure 6:
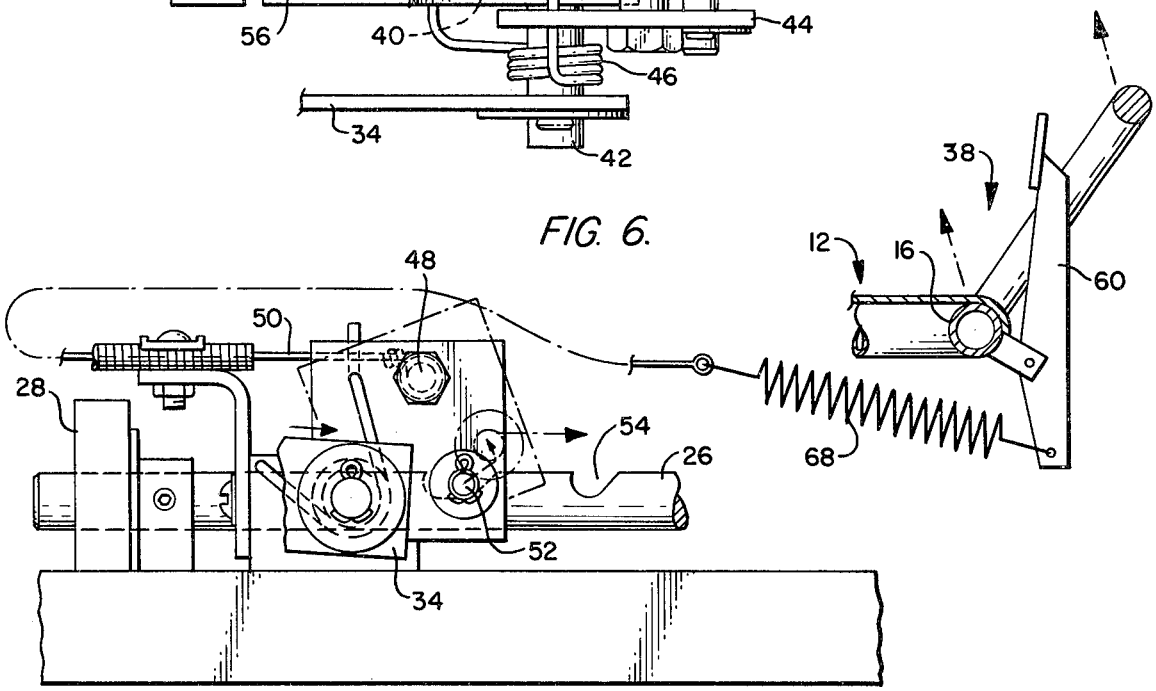
FIG. 6 is a partly schematic view showing how the trigger operates the traveling block.

As shown best in FIG. 4, one end of push-pull cable 36 is connected to the traveling block 32, and the other end of said cable is connected to the handle and trigger assembly 38 at the head end of Fowler 12 (see FIG. 6).

Referring now to FIGS. 4 to 7, the quick release traveling assembly 32 comprises a sliding block 40 which moves on the frame members 22 and 28. Sliding block 40 has a smooth central bore large enough to snugly but slidingly fit around ratchet bar 26. The linkage 34 is connected to the sliding block 40 on the main pivot pins 42 thereof.

Also mounted on the main pivot pins 42 of the sliding block 40 are a pair of side plates 44. These plates are pivotally mounted and are biased as shown by torsion springs 46, one on each side, trained about the main pivot pins 42. Plates 44 are joined together at their upper ends by a pin assembly 48. The core 50 of the push-pull cable 36 terminates at and is connected to pin 48. The plates 44 are normally biased to the right, clockwise, as shown in the drawings, by the ends of the torsion springs 46, connected to suitable openings in the block 40 and the plates 44. The plates 44 mount a second pin assembly 52 which cooperates with the slots or openings 54 in ratchet bar 26.

At the opposite end of the sliding block 40 a bracket 56 is provided, to which is mounted a clamp 58 by which the sheath 59 of the operating end of the push-pull cable 36 is secured to the traveling assembly 32.

Referring now to FIGS. 1, 3 and 6, there is shown the handle and trigger assembly 38 of the invention at the head end of the Fowler. Assembly 38 comprises a trigger member 60 which is pivotally mounted on a bifurcated yoke 62 fixed to the cross piece of "U" member 16 of the Fowler. A "U" shaped handle member 64 has its ends joined to this same cross piece and is positioned at a predetermined angle and in a predetermined relationship to the trigger member 60. A bracket 66 extends towards the foot end of the stretcher from the cross-piece part of member 16 and lies generally in the plane of the Fowler. Means are provided in the cross-piece section of bracket 66 to secure the sheath 59 of the push-pull cable 36, the core 50 thereof being connected to the end of the trigger member 60 via a spring 68.

Of course, the strength of spring 68 is selected so that it will not stretch when the pin is free to lift out of its ratchet bar slot, but will stretch to absorb trigger motion to set as a safety, all is decided in detail below in regard to the operation.

The location of spring 68 as shown is exemplary only. As will be clear from the operation below, the spring need only be in line with cable 36 and not in any particular location, i.e., it could be at the ratchet bar end, or between the ends of the cable at some other location which might be more desirable in some other specific application.

As appears in the drawings and perhaps best in FIG. 4, the leftmost notch or slot in the ratchet bar 26 is enlarged lengthwise of the bar. This is done for manufacturing purposes to accommodate the normal accumulation of tolerances that occurs in manufacturing, to thereby effect certain ecconomies of manufacture. The extra length of this particular notch is not functional because the Fowler is in the fully reclined position when this notch is contacted by pin 52, and thus the Fowler cannot move down any further. Other safety and stop means, partially shown, and not shown and not described herein, are provided, as is conventional, to prevent the Fowler from falling down below the plane of the stretcher top.

OPERATION

Figure 7:
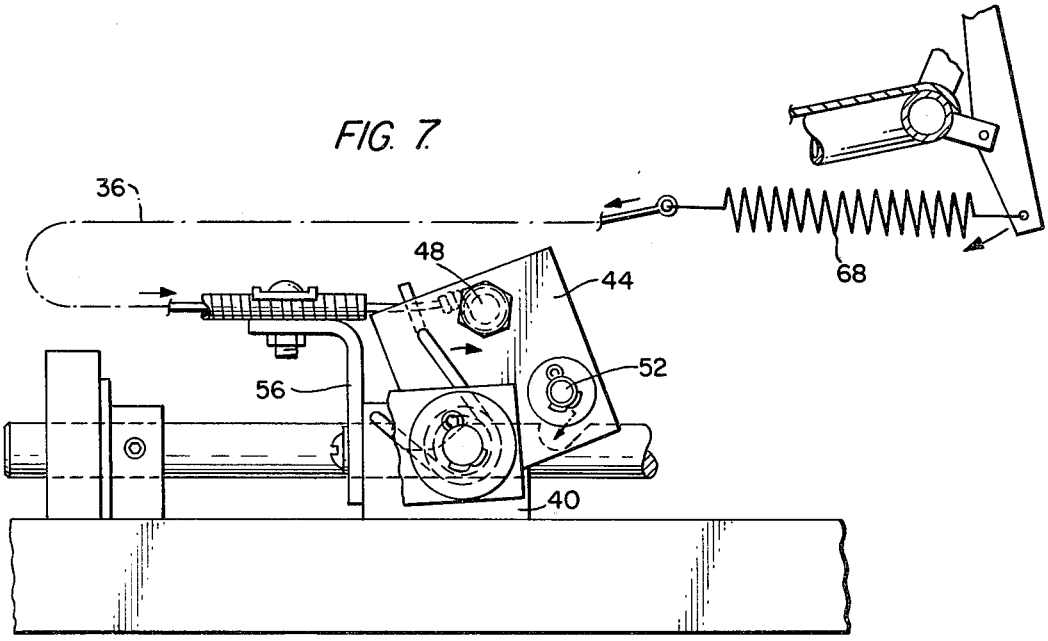
FIG. 7 is a view similar to FIG. 6 showing the next step in the operation.

The ratchet notches 54 in bar 26 have a shape which is important to the modus operandi of the invention. These notches are formed into the bar at an angle to the bar's axis entering from the head end of the stretcher towards the foot end. This angle produces a lip or overlap 55 which overlies the pin 52 when it is resting in any one notch 54, see FIG. 5. In order for the Fowler to move from any position to a lower position, the pin 52 must be raised out of the notch, as is indicated in FIG. 7. However, it will not so move, that is referring to FIG. 6, it will not move from the solid line to the phantom line position, because of the overlap 55 shown in FIG. 5, unless and until the user grasps the handle 64, and slightly raises the Fowler, thus of necessity assuming the weight of the top as well as the patient thereon, himself. That is, this slight lifting action will cause the pin to move backwards out from under the notch overlap 55, to only thereafter permit the rotational motion shown in FIG. 6. If an inattentive operator should attempt to operate the trigger member 60 in the direction of the lower arrow in FIG. 6, without first raising the handle in the direction of the upwardly pointing arrow, what would occur would be simply a stretching of the spring 68, which would have no effect whatsoever on the engagement of the pin 52 in that particular notch 54. That spring stretching together with the overlap 55 in the notch is the safety feature of the invention.

FIGS. 1 and 3 shows one handed operation of the invention. This is possible and useable particularly when the stretcher is empty, or if a very light person is on the stretcher, and if the attendant is strong enough and chooses to do so, or if the patient can help the attendant and thus free the attendant's other hand for other uses. However, as indicated in FIG. 3, the handle 64 is wide enough that the user can grasp it with both hands, as might be necessary for a heavy or an unconscious person or the like. The operating cross piece of the trigger 60 is shaped, as shown, so that it can be operated by either thumb, or with both thumbs if that should suit the attendant's convenience.

The rearwardly facing inclination of the notches 54 also provides the advantage in that it allows the Fowler to ratchet upwardly but never downwardly. That is, if the patient should be resting at 20°, as indicated in FIG. 1, and should choose to go to a sitting or reading position such as 60° or 70°, he or the attendant could move the Fowler upwardly to that position without using the handle and trigger mechanism 38 at all, the pin 52 simply ratcheting in and out of the various slots 54 as the Fowler moves from a lower to an upper position. However, the potentially dangerous opposite motion from an upper to a lower position is not possible without first operating the handle and trigger assembly 38 as described above.

As shown in FIG. 1, the Fowler of the invention is capable of various predetermined positions, including the straight 90° position which was not heretofore generally available in the prior art. This is easily accomplished by location of the various slots 54 in the ratchet bar 26. Different angles and positions can be done by more or fewer or different spacing of slots, due respect of course being given to the geometry of the system, primarily that of the linkage 34.

While the invention has been described in detail above, it is to be understood that this detailed description is by way of example only, and the protection granted is to be limited only within the spirit of the invention and the scope of the following claims.

We claim:

1. In a hospital stretcher having a top and a Fowler, the combination comprising means to support said Fowler at any one of a plurality of predetermined fixed angular positions of said Fowler with respect to the stretcher top, and manually operable means located on said Fowler to permit motion of said Fowler from a first of said angular positions to any other of said angular positions and said Fowler with respect to said stretcher top, said support means including a ratchet bar, linkage means interconnecting said Fowler and said ratchet bar, said ratchet bar being formed with a plurality of slots each corresponding to one of said plurality of fixed angular positions, pin means at the ratchet bar end of said linkage means cooperable with any one of said slots, and said manually operable means comprising means to release said pin means from said ratchet bar slot to permit said motion of said Fowler, said combination also including a traveling assembly which includes said pin means mounted on said ratchet bar for sliding motion longitudinally of said bar, said assembly comprising a pair of plates mounted one on each side of said ratchet bar, means to mount said pin on said plates, and spring means to bias said plates in a direction so as to normally urge said pin towards said ratchet bar slots.

2. The combination of claim 1, said stretcher comprising a frame on which said top and said Fowler are mounted, and said ratchet bar being mounted on said frame below said top, said release means comprising a push-pull cable connected at one end to said pin and at this other end to said manually operable means; whereby said pin can be remotely disengaged from said slot from said outer head end of said Fowler.

3. The combination of claim 8, and a safety spring connected between the Fowler end of said cable and said manually operable means, and means to prevent said pin from exiting said slot until the weight is relieved from said pin, whereby said safety spring will stretch to absorb the motion of said manually operated means if operated before said weight is relieved from said pin.

4. The combination of claim 1, each of said slots being formed into said ratchet bar at an angle to the axis of said bar sloping from the head end to the foot end of said stretcher top to thereby form an overlap portion overlying said pin when said pin is in said slot, and said slot overlap portion comprising a portion of safety means to prevent inadvertent motion of said Fowler towards the aligned normally horizontal position of said Fowler with respect to said top.

5. In a hospital stretcher having a top and a Fowler, the combination comprising means to support said Fowler at any one of a plurality of predetermined fixed angular positions of said Fowler with respect to the stretcher top, and manually operable means located on said Fowler to permit motion of said Fowler from a first of said angular positions to any other of said angular positions of said Fowler with respect to said stretcher top, said manually operable means being located at the outer head end of said Fowler, said manually operable means comprising a handle member fixed to said Fowler at said outer head end thereof and a trigger member pivotally mounted on said Fowler in a predetermined closely spaced position with respect to said handle member, whereby an operator can grasp said handle to move said Fowler while using the thumb of that same hand to operate said trigger member; means interconnecting said trigger member and said support means, and means to permit release of said interconnecting means upon operation of said trigger member in a predetermined manner.

6. The combination of claim 5, said interconnecting means comprising a push-pull cable, and means to fix the ends of the core of said cable at one end to said trigger member and at the other end to said interconnecting means.

7. In a hospital stretcher having a top and a Fowler, the combination comprising means to support said Fowler at any one of a plurality of predetermined fixed angular positions with respect to said top, manually operable means to permit motion of said Fowler from a first of said angular positions to any other of said angular positions of said Fowler with respect to said stretcher top, and said manually operable means having portions to prevent inadvertent motion of said Fowler towards the aligned normally horizontal position of said Fowler with respect to said top and to permit motion of said Fowler away from said aligned normally horizontal position of said Fowler with respect to said top, said manually operable means comprising a handle member fixed to said Fowler the outer head end thereof and a trigger member pivotally mounted on said Fowler in a predetermined closely spaced position with respect to said handle member, whereby an operator can grasp said handle to move said Fowler while using the thumb of that same hand to operate said trigger member; means interconnecting said trigger member and said support means, and means to permit release of said interconnecting means upon operation of said trigger member in a predetermined manner.

8. The combination of claim 7, said interconnecting means comprising a push-pull cable, and means to fix the ends of the core of said cable at one end to said trigger member at the other end to said interconnecting means.

9. In a hospital stretcher having a top and a Fowler, the combination comprising means to support said Fowler at any one of a plurality of predetermined fixed angular positions with respect to said top, manually operable means to permit motion of said Fowler from a first of said angular positions to any other of said angular positions of said Fowler with respect to said stretcher top, and said manually operable means having portions to prevent inadvertent motion of said Fowler towards the aligned normally horizontal position of said Fowler with respect to said top and to permit motion of said Fowler away from said aligned normally horizontal position of said Fowler with respect to said top, said support means including a ratchet bar, linkage interconnecting said Fowler and said ratchet bar, said ratchet bar being formed with a plurality of slots each corresponding to one of said plurality of fixed angular positions, pin means at the ratchet bar end of said linkage cooperable with any one of said slots, and said manually operable means comprising means to release said pin means from said ratchet bar slot to control said motion of said Fowler towards said aligned position of said Fowler, said stretcher comprising a frame on which said top and said Fowler are mounted, and said ratchet bar being mounted on said frame below said top, and a traveling assembly which includes said pin means mounted on said ratchet bar for sliding motion longitudinally of said bar, said assembly comprising a pair of plates mounted one on each side of said ratchet bar, means to mount said pin on said plates, and spring means to normally urge said pin towards said ratchet bar slots.

10. The combination of claim 9, said stretcher comprising a frame on which said top and said Fowler are mounted, and said ratchet bar being mounted on said frame below said top, said release means comprising a push-pull cable connected at one end to said pin and at this other end to said outer head end means; whereby said pin can be remotely disengaged from said slot from said outer head end of said Fowler.

11. The combination of claim 10, and a spring connected between the Fowler end of said cable and said manually operable means, and means to prevent said pin from exiting said slot until the weight is relieved from said pin, whereby said spring will stretch and will absorb the motion of said manually operated means if operated before said weight is relieved from said pin.

12. The combination of claim 9, each of said slots being formed into said ratchet bar at an angle to the axis of said bar sloping from the head end to the foot end of said stretcher top to thereby form an overlap portion overlying said pin when said pin is in said slot, and said slot overlap portion comprising a portion of said safety means to prevent inadvertent motion of said Fowler toward the aligned normally horizontal position of said Fowler with respect to said top.

13. In a hospital stretcher having a top and a Fowler, the combination comprising a frame for supporting said top and Fowler, a ratchet bar mounted on said frame having a plurality of ratchet slots formed therein, a traveling assembly operatively cooperable with said ratchet bar, said traveling assembly comprising a pin cooperable with any one of the slots in said ratchet bar, said traveling assembly comprising spring means urging said pin towards the slots in said ratchet bar, linkage interconnecting said traveling assembly and said Fowler, and manually operable means on said Fowler for moving said pin means out of a particular one of said ratchet bar slots in which said pin may be positioned, said linkage and the number and spacing of said ratchet bar slots defining a plurality of predetermined fixed angular positions of said Fowler with respect to said stretcher top.

14. The combination of claim 13, and safety means to prevent inadvertent motion of said Fowler towards the aligned normally horizontal position of said Fowler with respect to said top.

15. The combination of claim 14, each of said slots being formed into said ratchet bar at an angle to the axis of said bar sloping from the head end to the foot end of said stretcher top to thereby form an overlap portion which overlys said pin when said pin is in said slot, and said slot overlap portion comprising a portion of said safety means.

16. The combination of claim 14, said means to move said pin comprising a push-pull cable connected at one end to said pin and at its other end to said manually operable means, and a safety spring connected in line with said cable between said pin and said manually operable means, whereby said safety spring will stretch and absorb the motion of said manually operated means to thereby prevent said inadvertent motion of said Fowler.

17. The combination of claim 14, said manually operable means comprising a handle member fixed to said Fowler at the outer head end thereof and a trigger member pivotally mounted on said Fowler in a predetermined closely spaced position with respect to said handle member, whereby an operator can grasp said handle to move said Fowler while using the thumb of that same hand to operate said trigger member, means interconnecting said trigger member and said pin, and means to permit release of said pin from a ratchet bar slot upon operation of said trigger member in a predetermined manner.

* * * * *